US005223766A

United States Patent [19]

Nakayama et al.

[11] Patent Number: 5,223,766

[45] Date of Patent: Jun. 29, 1993

[54] IMAGE DISPLAY DEVICE WITH CATHODE PANEL AND GAS ABSORBING GETTERS

[75] Inventors: Akira Nakayama, Tokyo; Junichi Inoue, Ibaragi; Masanobu Yamamoto, Kanagawa, all of Japan

[73] Assignee: Sony Corporation, Tokyo, Japan

[21] Appl. No.: 692,319

[22] Filed: Apr. 26, 1991

[30] Foreign Application Priority Data

Apr. 28, 1990 [JP] Japan ..... 2-112731
Apr. 28, 1990 [JP] Japan ..... 2-112732
Apr. 28, 1990 [JP] Japan ..... 2-112733

[51] Int. Cl.[5] ..... H01J 1/88; H01J 7/18

[52] U.S. Cl. ..... 313/495; 313/553; 313/558; 313/559; 313/309

[58] Field of Search ..... 313/495, 558, 559, 422, 313/481, 553, 309, 336

[56] References Cited

U.S. PATENT DOCUMENTS 2,547,200 4/1951 Dorgelo ..... 313/559
2,868,610 1/1959 Beggs ..... 313/558 X
3,264,510 8/1966 Griffiths ..... 313/481
3,885,499 12/1974 Yamada et al. ..... 313/336 X
3,980,446 9/1976 della Porta ..... 29/191
4,578,614 3/1986 Gray et al. ..... 313/336 X
4,608,518 8/1986 Fukuda et al. ..... 313/495 X
4,835,438 5/1989 Baptist et al. ..... 313/309
4,972,116 11/1990 Tatsuda et al. ..... 313/422
5,063,323 11/1991 Longo et al. ..... 313/309

FOREIGN PATENT DOCUMENTS 0025221 3/1981 European Pat. Off. .
0198044 10/1985 Japan ..... 313/481
2-100242 4/1990 Japan .
1186581 4/1979 United Kingdom .

OTHER PUBLICATIONS

Patent Abstracts of Japan vol. 14 No. 308, Mar. 7, 1990.

*Primary Examiner*—Palmer C. Demeo
*Attorney, Agent, or Firm*—Hill, Steadman & Simpson

[57] ABSTRACT

A thin type image display device for displaying an image by emitting light from a fluorescer with irradiation of electron beams thereto. The device has a cathode panel between a front panel and a back panel in such a manner that a space is existent between the cathode panel and the back panel, wherein through holes for diffusion of getters are formed in the cathode panel to maintain the image quality at the center of a display screen, or the cathode panel is supported by getters to maintain a required pressure, hence attaining a higher image quality even on a large-sized display screen. A gate electrode may be composed of a getter material.

10 Claims, 11 Drawing Sheets

IMAGE DISPLAY DEVICE WITH CATHODE PANEL AND GAS ABSORBING GETTERS

BACKGROUND OF THE INVENTION

1. Field of the Invention

The present invention relates to a thin type image display device for use in a video apparatus, such as a color television receiver.

2. Description of the Prior Art

Relative to a system for realizing a thin type color television receiver, for example, there is proposed an image display device wherein a cathode serving as an emission source is disposed in a thin vacuum panel assembly composed of a front panel and a back panel, and electron beams are emitted from the cathode to excite a fluorescent member to thereby display a desired image.

In such a known device, a getter is employed for adsorbing residual gases (inclusive of gases generated from component elements) so as to maintain a proper pressure in the vacuum panel assembly. Since it is impossible to provide such a getter in any portion corresponding to the effective screen area, the getter is placed mostly in a peripheral region between the front panel and the cathode outside of the effective screen area.

However, if the getter is disposed in the periphery of the effective screen area, the portion other than the effective screen area is dimensionally increased to consequently reduce the substantial effective screen. There is also the disadvantage of diminution of the gas adsorption effect at the center of the screen, hence raising a problem with regard to deterioration of the image quality. To the contrary, if the portion other than the effective screen area is minimized, it is impossible to contain a sufficient amount of the getter required for maintaining the pressure so that satisfactory image quality is eventually not attained.

There is known another conventional thin type image display device as disclosed in Japanese Patent Laid-open No. Sho 60 (1985)-101844, wherein a space is formed between a cathode and a back panel, and some getter is contained in this space.

In the above device where the getter is disposed between the cathode and the back panel, a sufficient area of the effective screen can be ensured, and also a required amount of the getter can be contained for maintaining a proper pressure.

In the device mentioned, however, the getter is disposed behind the cathode on the reverse side with respect to the front panel where out-gases are mostly generated so that the out-gases at the center of the display screen cannot be adsorbed instantaneously due t the impediment induced by the cathode. Consequently it becomes impossible to maintain the proper pressure in the vacuum panel assembly, and there occurs deterioration of the cathode as well. Furthermore, the image quality is degraded at the center of the screen which eventually fails in attaining a higher image quality.

There also exists a disadvantage that a satisfactory vacuum pressure withstanding capability is not achievable since the cathode is supported merely at the outer periphery thereof. The above device is constructed so that the cathode is supported via a glass plate from behind by means of U-shaped spring members disposed at four corners of the back panel. However, such a structure is not exactly suited for ensuring a pressure withstanding capability and the cathode is prone to be broken as the pressure in the vacuum panel is rendered high, particularly in a large-sized display screen.

OBJECTS AND SUMMARY OF THE INVENTION

It is an object of the present invention to provide an improved thin type image display device capable of containing a sufficient amount of getter for maintaining a required pressure, wherein the image quality can be maintained at the center of a display screen so that a superior image quality is attainable, even on a large-sized screen.

Another object of the present invention is to provide an improved thin type image display device wherein out-gases are adsorbable instantaneously and a high pressure can be maintained.

A further object of the present invention resides in providing an improved thin type image display device which ensures a superior vacuum pressure withstanding capability, even in a large-sized display screen.

According to one aspect of the present invention, there is provided an image display device having a cathode panel between a front panel and a back panel in such manner that a space is existent between the cathode panel and the back panel, wherein a plurality of getter-diffusing through holes are formed in the cathode panel. In this image display device, a space is existent between a back panel and a cathode panel disposed opposite to a front panel, so that a sufficient amount of getters for maintaining a required pressure can be contained in such space. Furthermore, a plurality of through holes for diffusion of getters are formed in the cathode panel to realize adsorption of residual gases at the center of a display screen via such through holes, thereby attaining a superior image quality, even on a large-sized display screen.

According to another aspect of the present invention, there is provided an image display device comprising a front panel and a cathode panel disposed opposite to the front panel and furnished with gate electrodes for extracting electron beams, wherein the gate electrodes are composed of a getter material. In such an image display device, the gate electrodes provided on the cathode panel opposite to the front panel for extracting electron beams are composed of a getter material so that, when out-gases are generated due to the striking of electron beams upon the front panel, such out-gases are adsorbed instantaneously by the gate electrodes disposed opposite to the front panel.

And according to a further aspect of the present invention, there is provided an image display device having a cathode panel between a front panel and a back panel in such a manner that a space is existent between the cathode panel and the back panel, wherein the cathode panel is supported in the space by a plurality of getters. In this image display device, a space is existent between a back panel and a cathode panel disposed opposite to a front panel, so that a sufficient amount of getters for maintaining a required pressure can be contained in this space. Furthermore, the cathode panel is supported in this space by a plurality of getters so that the pressure applied to the cathode panel is dispersed by the getters to consequently prevent breakage of the cathode panel.

The above and other features and advantages of the present invention will become apparent from the following description which will be given with reference to the illustrative accompanying drawings.

DESCRIPTION OF THE PREFERRED EMBODIMENTS

Hereinafter exemplary embodiments of the present invention will be described in detail with reference to the accompanying drawings.

Figure 1:
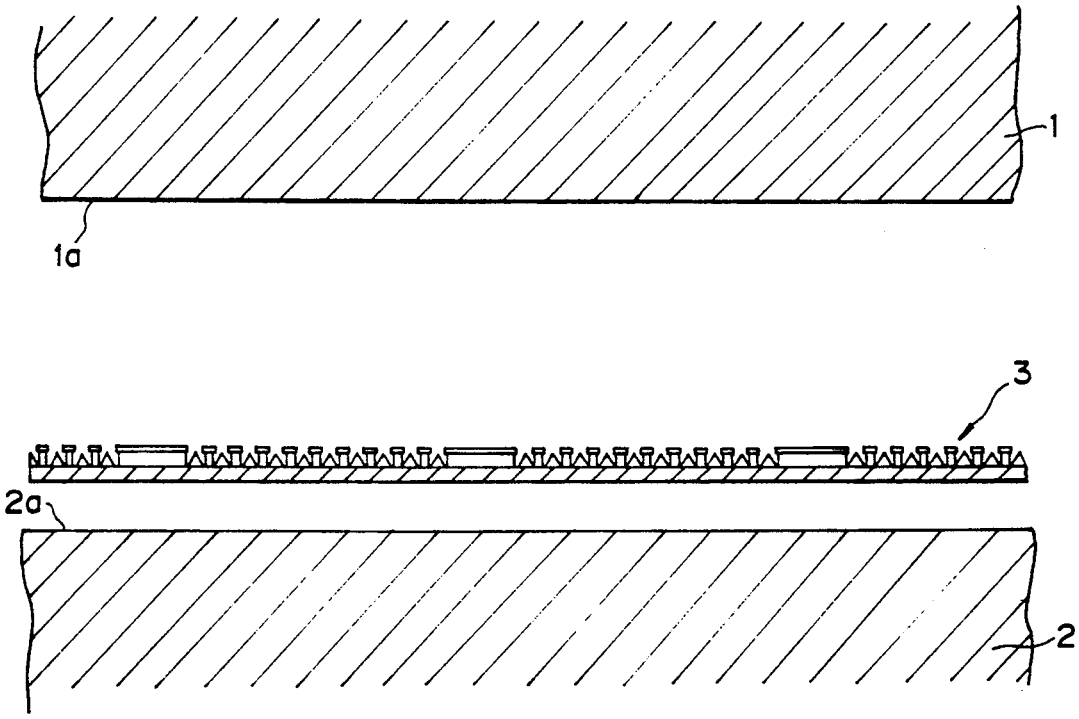
FIG. 1 is a sectional view of an exemplary image display device embodying the present invention.
Figure 2:
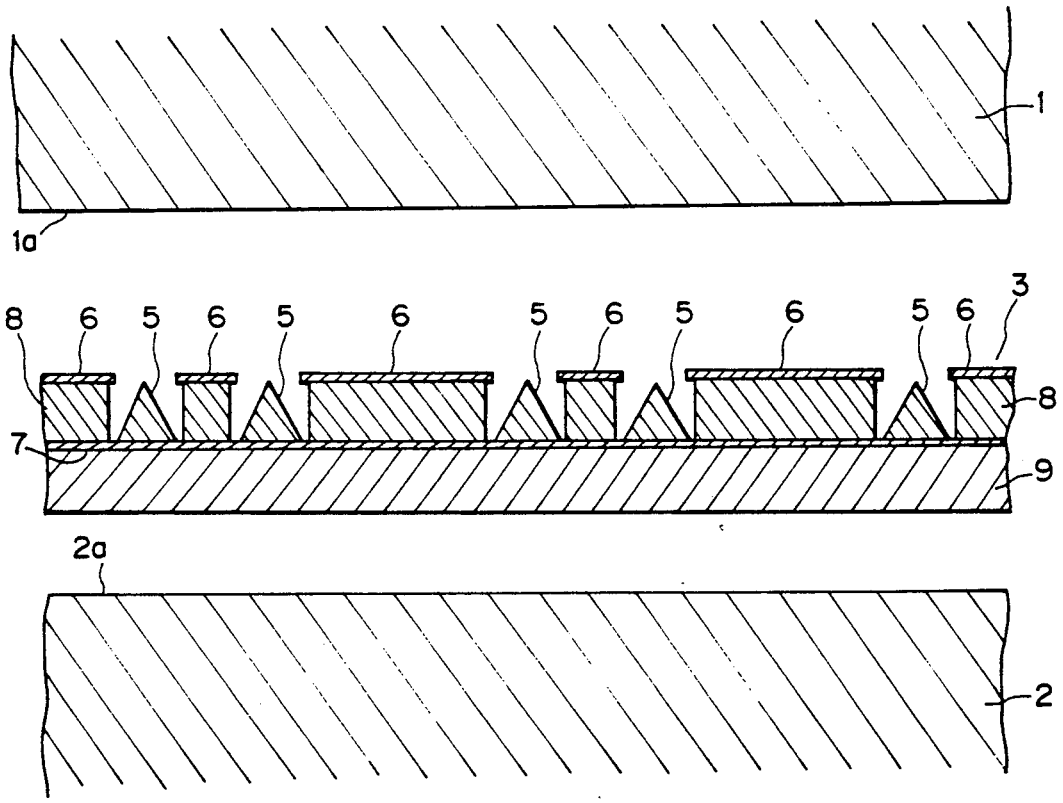
FIG. 2 is an enlarged sectional view of principal components in the device of FIG. 1.
Figure 3:
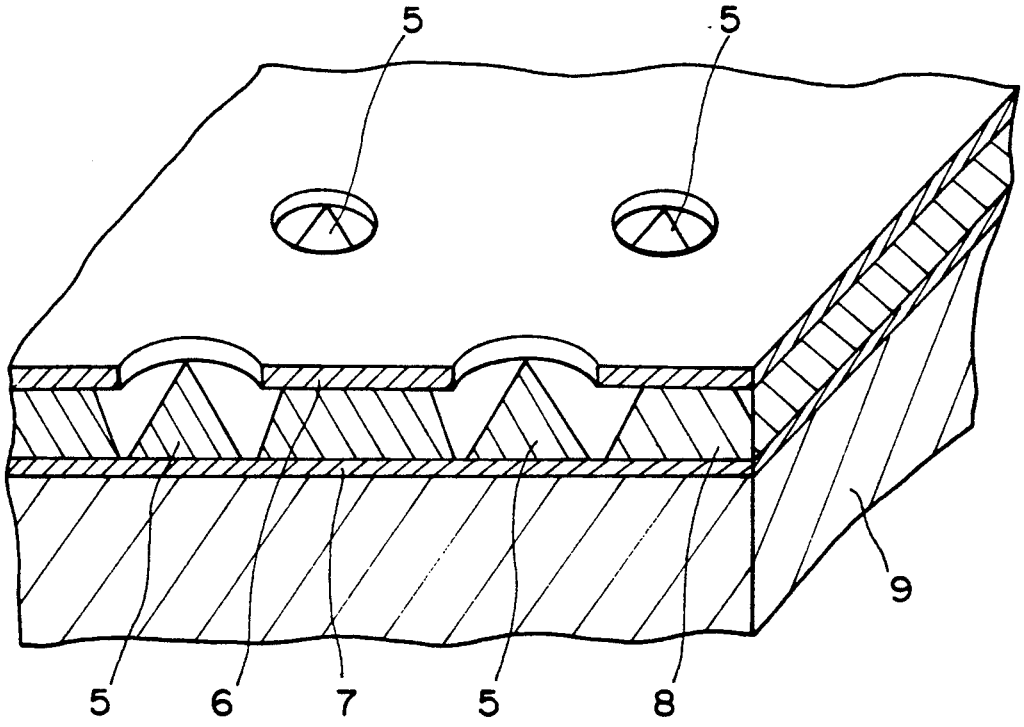
FIG. 3 is a partially cutaway enlarged perspective view of principal components in an exemplary cathode panel composed of extremely small cold cathodes.

As shown in FIGS. 1 through 3, the image display device in a first embodiment includes a cathode panel 3 serving as an emission source and disposed in a vacuum receptacle which comprises a front panel 1 and a back panel 2 of glass.

The, front panel 1 has, on its inner wall 1*a*, fluorescent stripes in the colors of, for example, red (R), green (G) and blue (B), thereby forming a fluorescent display screen (not shown).

Meanwhile the back panel 2 is joined to the front panel 1 in a state where the two panels are sealed up, and an internal space surrounded with the front panel 1 and the back panel 2 is evacuated.

The cathode panel 3 is interposed between the front panel 1 and the back panel 2, and electron beams emitted from the cathodes provided on the cathode panel 3 are irradiated to the fluorescent display screen of the front panel 1. The cathode panel 3 is disposed opposite to both the front panel 1 and inner walls 1*a*, 2*a* of the back panel 2, in such a manner that a space 4 is existent between the cathode panel 3 and the inner wall 2*a* of the back panel 2. The space 4 is used for containing getters (not shown) composed of an alloy of Ba, Ti or Zn for adsorbing gases generated from component elements (such as extraction electrodes 6 and so forth mentioned hereafter which are formed on the cathode panel 3. The space 4 is defined so as to have adequate dimensions for receiving a sufficient amount of the getter to maintain a required pressure.

The cathode panel 3 in this embodiment has a multiplicity of extremely small cold cathodes arrayed as illustrated in FIG. 2. There are included cathodes 5 each serving as an emission source, extraction electrodes 6 for extracting electron beams from the cathodes 5, the cathode lines 7 for supplying potentials (potential signals) to the cathodes 5, and isolation layers 8 for isolating the extraction electrodes 6 from the cathode lines 7. Such components are arranged on a base plate 9 by a semiconductor manufacturing process.

The cathodes 5 are composed of molybdenum, tungsten or lanthanum hexaboride ($LaB_6$) for example, and are shaped into extremely small conical projections each having a diameter of 1.0 micron or less. Such cathodes 5 are arrayed on the base plate 9 correspondingly to individual fluorescer dots provided on an inner wall 1*a* of the front panel 1.

The extraction electrodes 6 for extracting electron beams from the cathodes 5 are formed on the isolation layers 8 which are shaped so as to surround the cathodes 5 arcuately. The extraction electrodes 6 are formed in a manner to constitute a matrix structure by the cathode lines 7 provided between the cathodes 5 and the base plate 9. Therefore, when potential signals are supplied to the cathode lines 7 provided under the cathodes 5 in the cathode panel 3, electron beams are extracted from the tips of the cathodes 5 by the extraction electrodes 6. The electron beams can be selectively emitted from the cathodes 5 by selective operation of the extraction electrodes 6 and the cathode lines 7.

Figure 4:
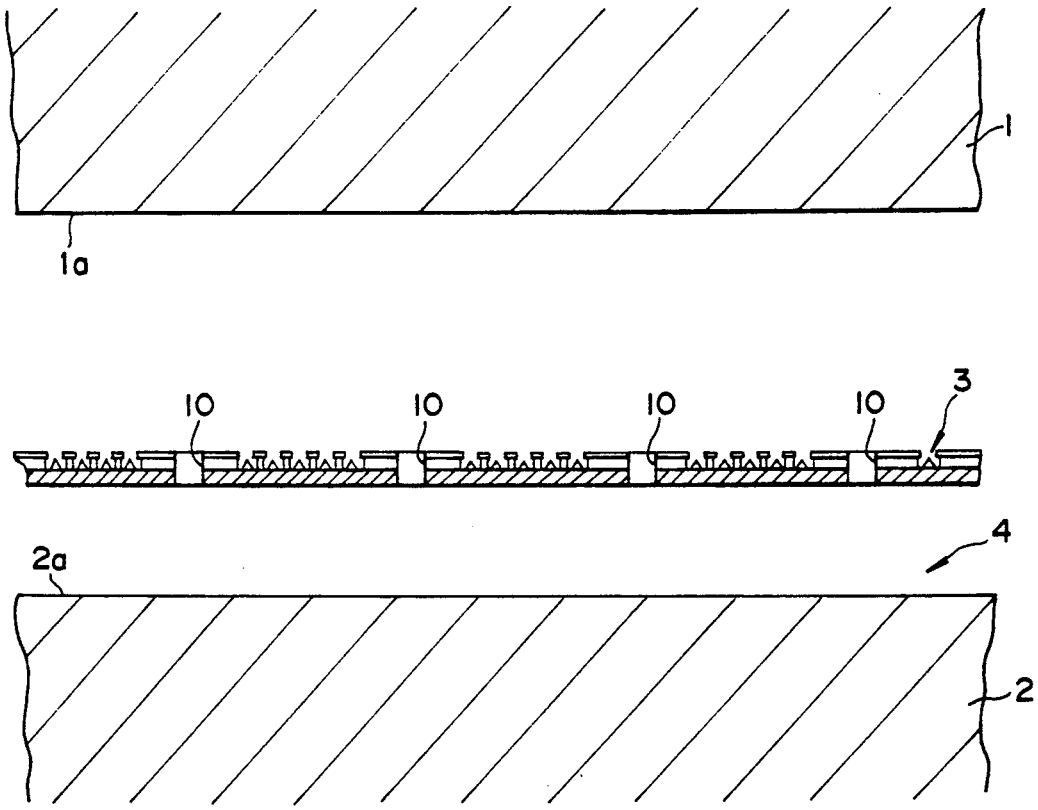
FIG. 4 is a sectional view of another exemplary image display device embodying the present invention.
Figure 5:
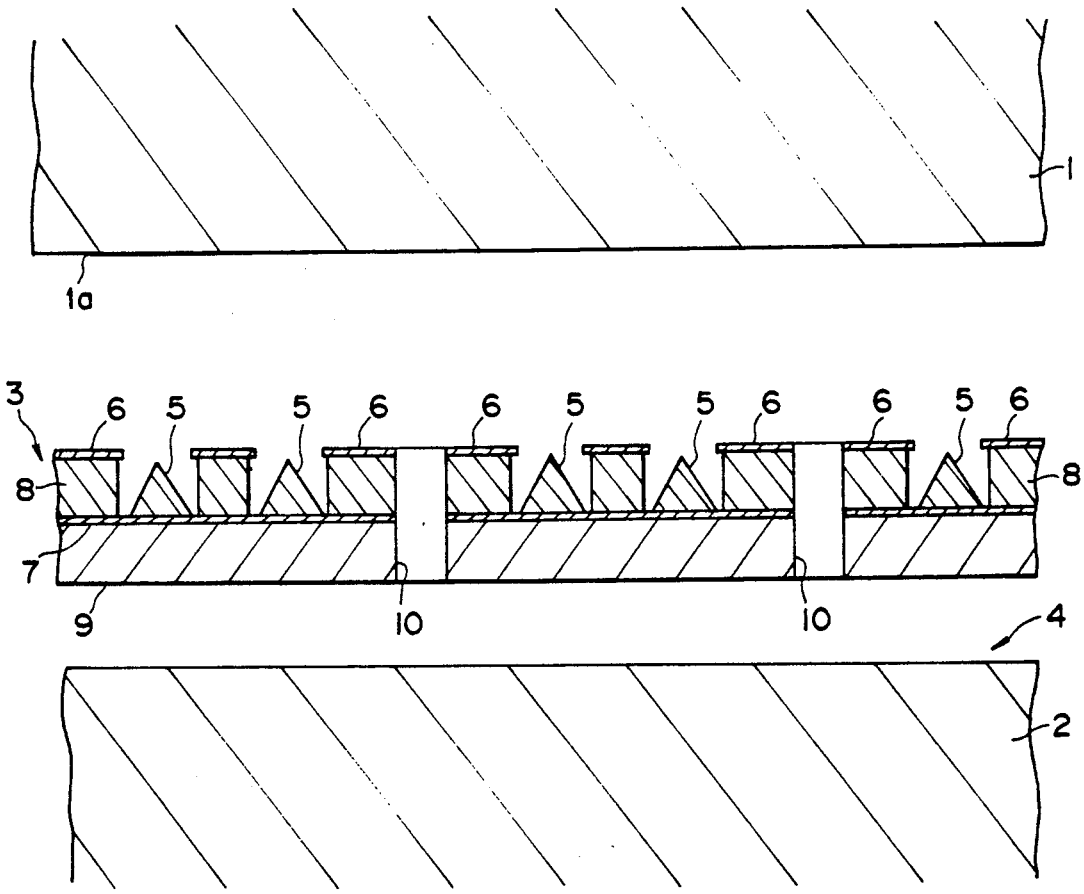
FIG. 5 is an enlarged sectional view of principal components in the device of FIG. 4.

In the cathode panel 3 so constituted as mentioned above, a plurality of getter-diffusing through holes 10 are formed for effectively exerting the action of getters, as shown in FIGS. 4 and 5. The through holes 10 are positioned in suitable positions of the front panel 1 corresponding at least to the effective screen area, in such a manner as to pierce through the extraction electrodes 6, the isolation layers 8, the cathode lines 7 and the base plate 9 sequentially in the direction of depth. Consequently any residual gases at the center of the screen in the front panel 1 are adsorbed via the through holes 10 by the getters provided in the space 4 between the back panel 2 and the cathode panel 3. In particular, since the field emission cathodes employed in this embodiment are prone to be harmfully effected by gas-induced contamination, the image quality is degraded unless a satisfactory gas adsorption effect is achieved over the entire surface of the screen, and therefore the through holes 10 formed in the cathode panel 3 are effective to avert such a problem.

In the image display device of the construction mentioned, electron beams emitted from the tips of the cathodes 5 operated selectively are irradiated to the fluorescent stripes formed on the inner wall 1*a* of the front panel 1. And individual fluorescer dots of the fluorescent stripes at the irradiated spots are caused to emit light to thereby form a color image. In this stage, some gases are generated from the extraction electrodes 6 and so forth provided on the cathode panel 3, but such gases are adsorbed via the through holes 10 in the cathode panel 3 by the getters provided in the space 4 between the cathode panel 3 and the back panel 2. Accordingly, in the image display device of the present invention, the image quality can be maintained at the center of the screen to eventually realize a higher image quality in the entire screen area. Furthermore, in the device of the present invention where getters are provided between the cathode panel 3 and the back panel 2, a sufficient amount of the getters can be contained to thereby maintain a proper pressure in the vacuum receptacle.

In another embodiment of the present invention, the gate electrodes 6 shown in FIGS. 1 and 2 may be composed of a getter material for serving to adsorb outgases generated due to impingement of electron beams upon the fluorescent screen of the front panel 1 and so forth. It is therefore necessary for each gate electrode 6 to have a function as an electrode to extract an electron beam and also another function as a getter to adsorb the out-gases. For meeting such requirements, the gate electrode is composed of a nonevaporable material having a getter effect when activated. For example, an adequate non-evaporable getter material may be selected from alloys of Ta, Zr, Ti and Hf. By the use of such getter material for the gate electrodes 6, it is rendered possible to extract electron beams from the cathodes, and each gate electrode 6 activated by the application of a voltage functions as a getter. Since the gate electrodes 6 are provided at least in a portion corresponding to the fluorescent screen on the front panel 1, a sufficient amount of the getter can be ensured for maintaining a desired pressure in the vacuum receptacle.

When the gate electrodes 6 are composed of a getter material as described above, any out-gases generated due to impingement of electron beams upon the front panel 1 can be adsorbed instantaneously by the gate electrodes 6 which are existent in the proximity of the front panel 1. Consequently it becomes possible to maintain the proper pressure in the vacuum receptacle, and the image quality at the center of the screen can be maintained to thereby attain a higher image quality. In addition, since the gate electrode 6 has another function as a getter, the thickness of the panel can be reduced more to render the image display device even thinner as a whole.

Figure 6:
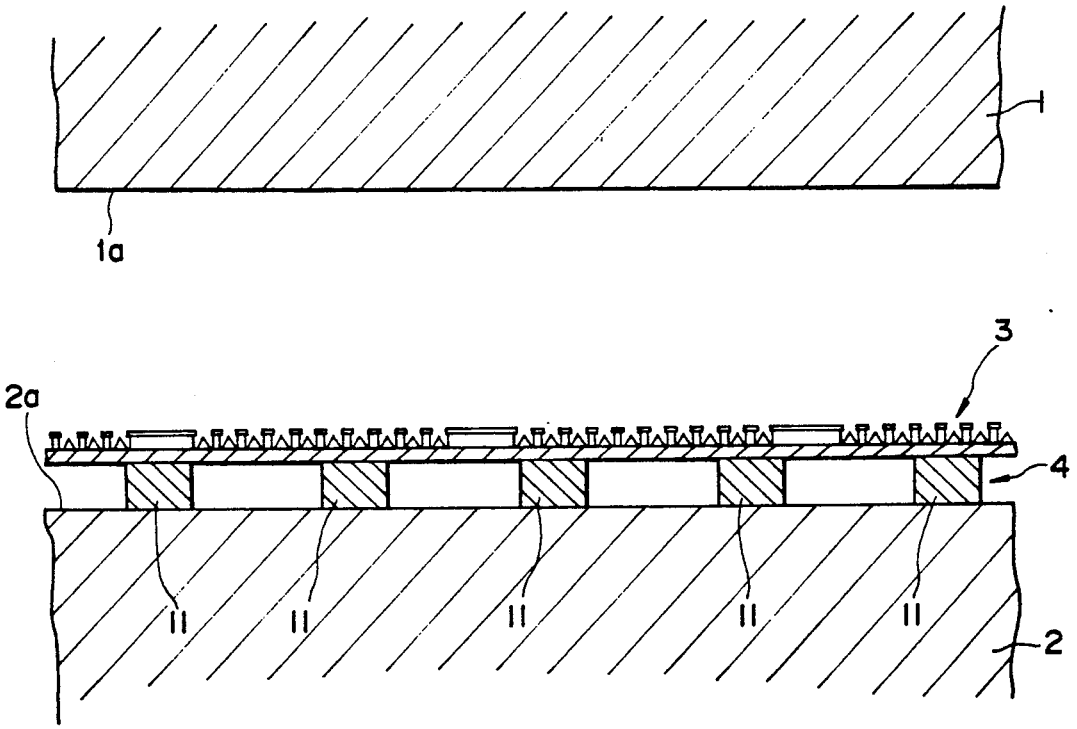
FIG. 6 is a sectional view of a further exemplary image display device embodying the present invention wherein a cathode panel is supported by getters.
Figure 7:
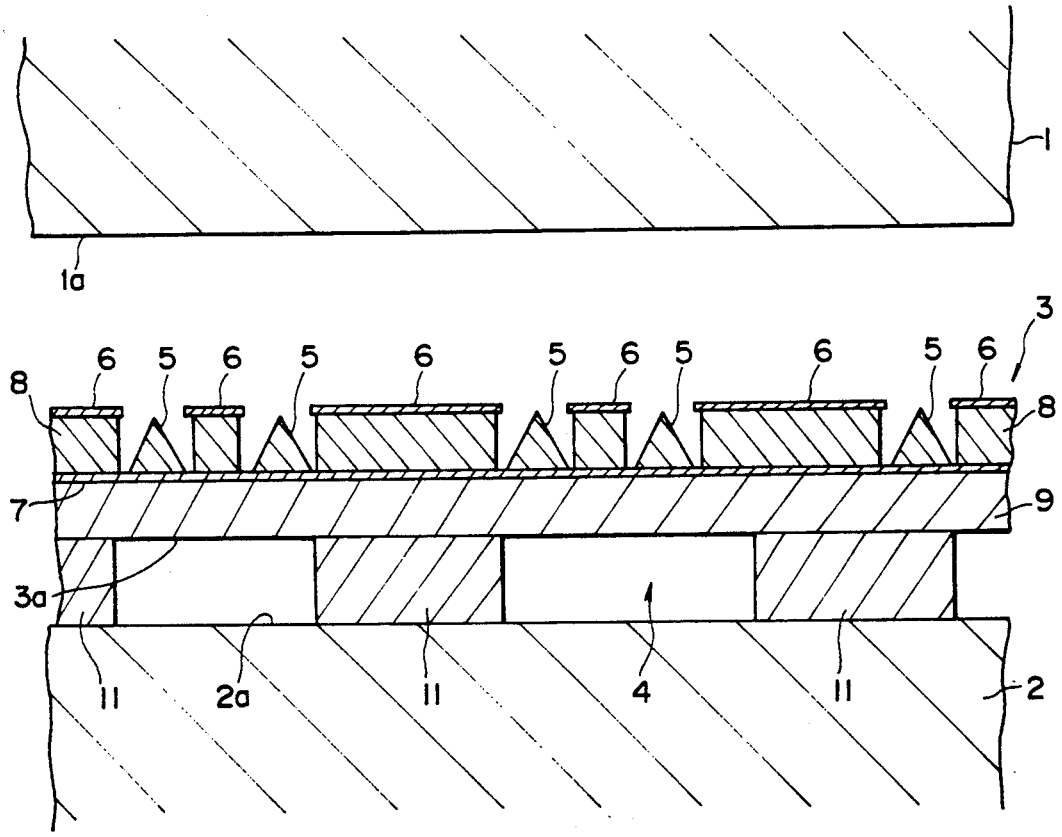
FIG. 7 is an enlarged sectional view of principal components in the device of FIG. 6.

In a further embodiment of the present invention, as shown in FIGS. 6 and 7, a plurality of cylindrical getters 11 sufficient in amount for maintaining a required pressure are received in the space 4. More specifically, such getters 11 are placed in contact with both the inner wall 2*a* of the back panel 2 and the back surface 3*a* of the cathode panel 3 in a manner to support the cathode panel 3. The getters 11 are disposed so as to uniformly disperse any pressure applied to the cathode panel 3, thereby preventing breakage of the cathode panel 3. Accordingly, even when the pressure in the vacuum receptacle is rendered high in accordance with a dimensional increase of the display screen, it is still possible to completely support the cathode panel 3, hence preventing breakage of the cathode panel 3 with certainty.

Figure 8:
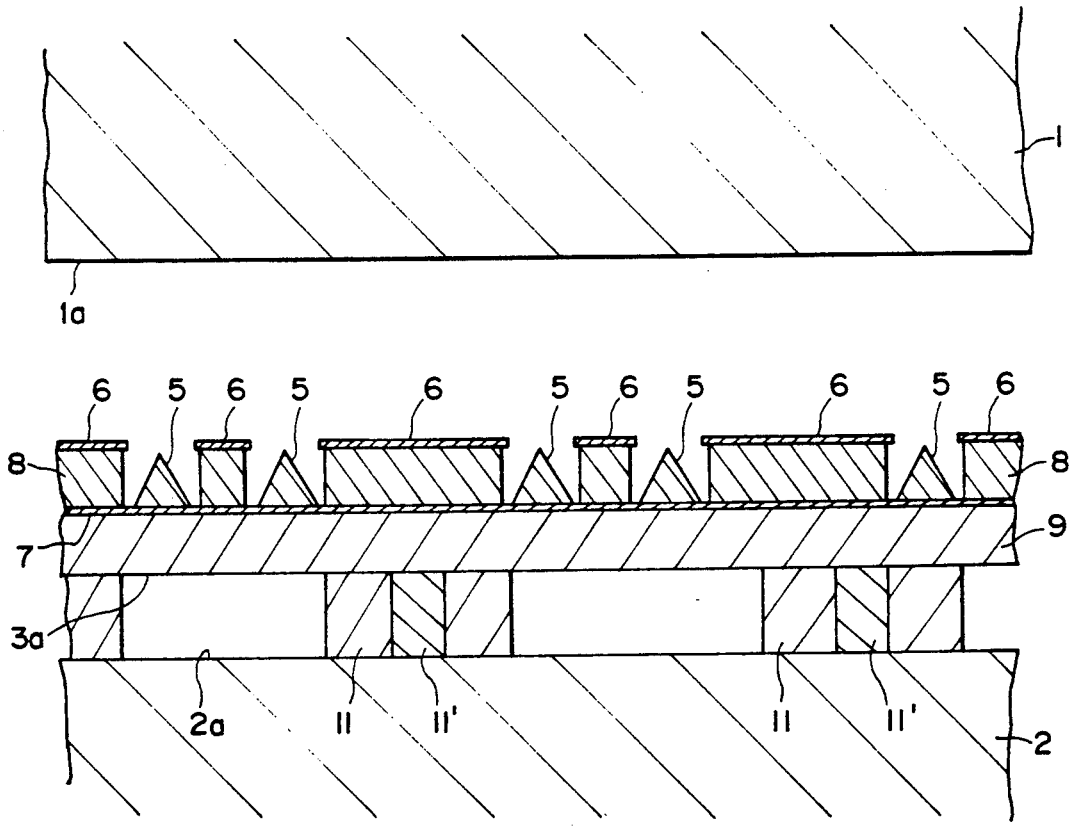
FIGS. 8 and 9 illustrate modifications of the image display device shown in FIG. 6.

In addition to the above, some auxiliary members 11' of round bars or the like may be provided at the respective centers of cylindrical getters 11, as illustrated in FIG. 8. In such a structure, the vacuum pressure withstanding capability can be further enhanced.

Figure 9:
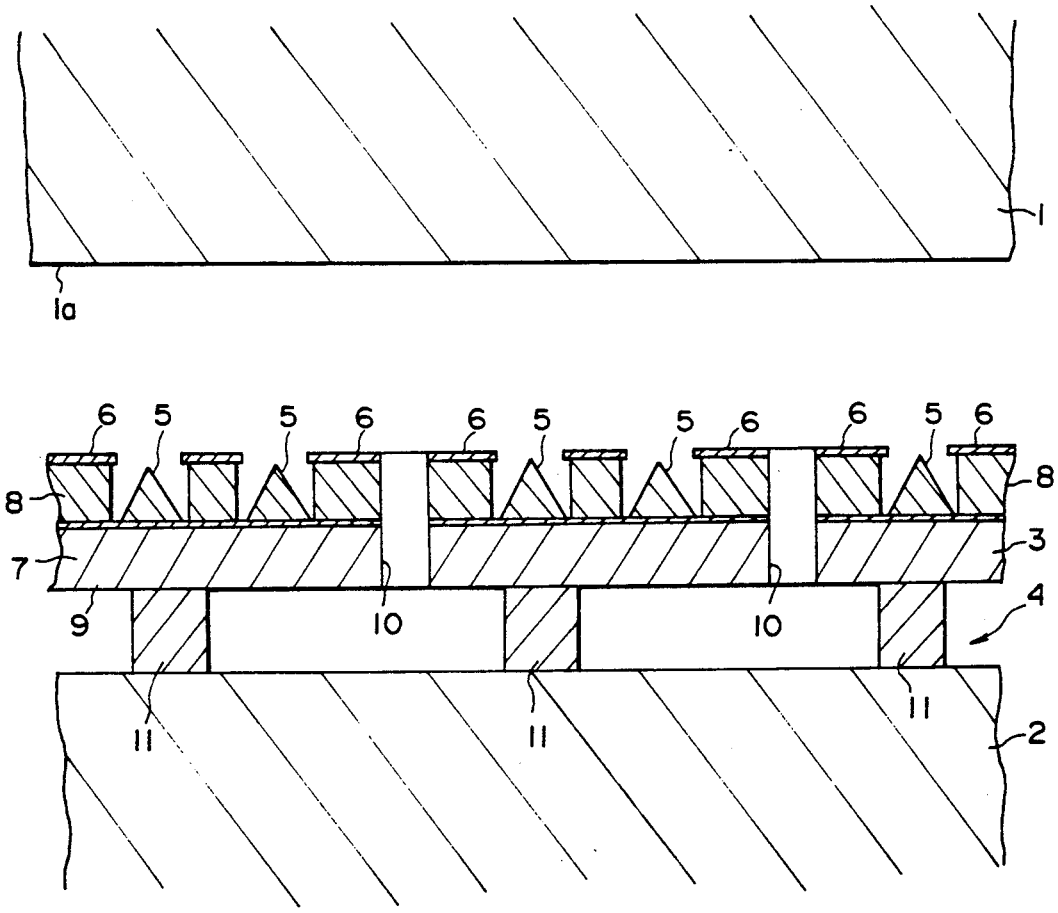

In a modification, as shown in FIG. 9, getter-diffusing through holes 10 for effectively exerting the action of the getters 11 may be formed at suitable positions in the cathode panel 3 corresponding to the effective screen area. Then any residual gases generated in the center portion of the screen area are adsorbed by the getters 11 via the through holes, to consequently improve the image quality at the center of the display screen.

In the image display device of the present invention mentioned, a variety of changes and modifications may be contrived within the scope of the invention and not departing from the inventive concept thereof.

Figure 11:
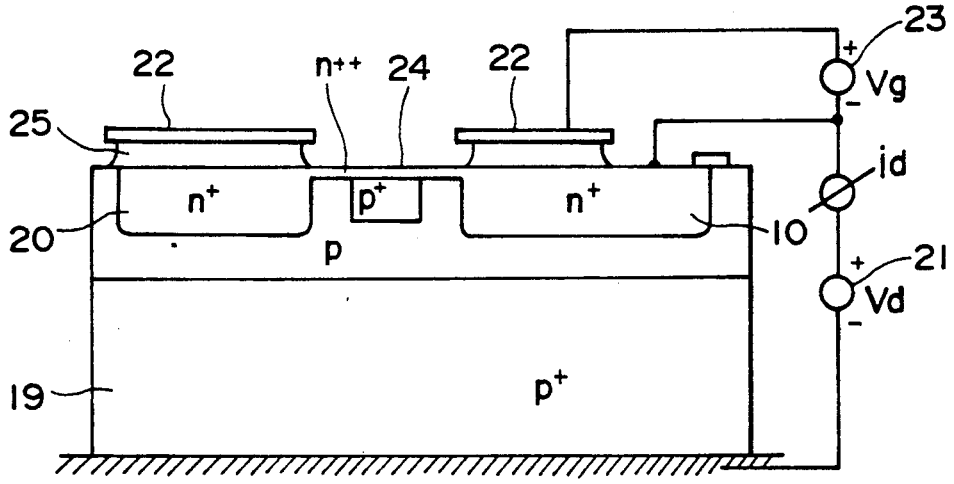

For example, in place of the extremely small cold cathodes used for emitting electron beams in the above embodiment, it is possible to employ a cathode panel composed of semiconductor elements as illustrated in FIG. 11.

Figure 10:
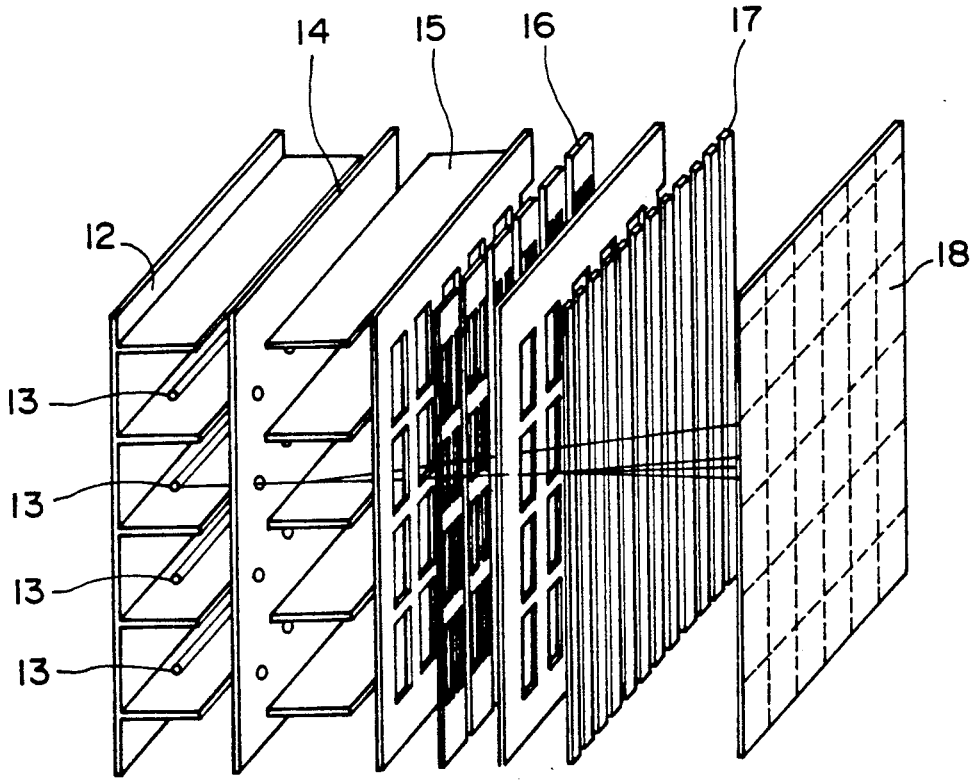
FIGS. 10 and 11 are schematic perspective views showing other examples of the cathode panel.

The cathode panel in the above modification comprises a back electrode 12, filament cathodes 13, a first grid electrode 14, vertical deflection electrodes 15, signal modulation electrodes 16 and a horizontal deflection electrode 17, as illustrated in FIG. 10.

In the cathode panel mentioned above, a matrix is constituted by a plurality of filament electrodes 13 disposed horizontally at predetermined vertical intervals and a plurality of signal modulation electrodes 16 disposed vertically at predetermined intervals, so as to control the electron beams emitted from the filament cathodes 13.

Furthermore, in the above cathode panel, the vertical deflection system is formed by, e.g., 15 pairs of vertical deflection electrodes 15 arranged correspondingly to the filament cathodes 13; while the horizontal deflection system is formed by, e.g., 200 pairs of horizontal deflection electrodes 17 arranged correspondingly to the signal modulation electrodes 16.

When different negative pulse voltages are sequentially applied to the filament cathodes 13 in the cathode panel of the above-described construction, the potential at the first grid electrode 14 is rendered relatively positive, and a positive electric field is generated in the periphery of each filament cathode 13, so that the band-shaped electron beam is emitted toward the first grid electrode 14. Such a band-shaped electron beam is advanced via the through hole formed in the first grid electrode 14 and is thereby divided into electron beams equal in number to the through holes. Thereafter, such divided electron beams are vertically converged at the same time to be vertically deflected and then are excited to the fluorescent stripes on the front panel 18, thereby causing the individual fluorescer dots to emit light therefrom.

In a further modification, it is also possible to employ a cathode panel composed of semiconductor elements as illustrated in FIG. 11.

The cathode panel in FIG. 11 is constructed so that a bias source 21 is provided for applying a bias between a p-type substrate 19 and an n-type impurity region 20, and also a signal source 23 is provided for applying a gating voltage between the n-type impunity region 20 and a gate electrode 22 disposed via an insulator layer 25 of silicon dioxide.

In the cathode panel mentioned above, a bias is applied between the p-type substrate 19 and the n-type impurity region 20, and gating is executed by the n-type impurity region 20 and the gate electrode 22, so that electrons are emitted from a p-n junction 24 which is thin as 10 nm or so. The emission of electrons is controlled by the signal source 23.

Although various minor changes and modifications might be proposed by those skilled in the art, it will be understood that we wish to include within the claims of the patent warranted hereon all such changes and modifications as reasonably come within our contribution to the art.

What is claimed is:

1. An image display device, comprising:

a light transparent front panel, a back panel, and a cathode panel between the front and back panels;

a plurality of image forming phosphorescent elements comprising fluorescer members on said front panel;

said cathode panel being formed of a base plate, cathode lines on the base plate, a plurality of individual cold cathodes connecting to the cathode lines on the base plate, an isolation layer overlying the cathode lines on the base plate and having apertures in which are positioned the individual cathodes, and means for extracting electron beams from the individual cathodes which are directed towards corresponding fluorescer members, said means for extracting comprising extraction electrodes on the isolation layer adjacent the individual cathodes;

a space between the cathode panel and the back panel, and gas absorbing getters being provided in said space; and a plurality of through hole means in an active image area and including a center of said image display device for diffusion of residual gases from the active image area and center thereof between the front panel and cathode panel through said hole means to said gas absorbing getters, said hole means comprising a plurality of holes distributed throughout said active image area and adjacent the cathode elements, said holes piercing through said base plate, isolation layer, and extraction electrodes.

2. An image display device according to claim 1 wherein said cathodes comprise conical projections having a diameter of substantially one micron or less.

3. An image display device, comprising:

a light transparent front panel, a back panel, and a cathode panel between the front and back panels;

a plurality of image forming phosphorescent elements comprising fluorescer members on said front panel;

said cathode panel being formed of a base plate, cathode lines on the base plate, a plurality of individual cold cathodes connecting to the cathode lines on the base plate, an isolation layer overlying the cathode lines on the base plate and having apertures in which are positioned the individual cathodes, and means for extracting electron beams from the individual cathodes which are directed towards corresponding fluorescer members, said means for extracting comprising extraction electrodes on the isolation layer adjacent the individual cathodes;

a space between the cathode panel and the back panel, and gas absorbing getters being provided in said space;

a plurality of through hole means in an active image area and including a center of said image display device for diffusion of residual gases from the active image area and center thereof between the front panel and cathode panel through said hole means to said gas absorbing getters, said hole means comprising a plurality of holes distributed throughout said active image area and adjacent the cathode elements, said holes piercing through said base plate, isolation layer, and extraction electrodes; and the getters in said space between said cathode panel and back panel comprising piller shaped supports formed of a getter material distributed throughout said active image area of said display device adjacent said holes and between said cathode panel and back panel so as to support said cathode panel by said back panel in a distributed manner.

4. An image display device according to claim 3 wherein said pillar shaped getter material supports are cylindrical.

5. An image display device, comprising:

a light transparent front panel, a back panel, and a cathode panel between the front and back panels;

a plurality of image forming phosphorescent elements comprising fluorescer members on said front panel;

said cathode panel being formed of a base plate, cathode lines on the base plate, a plurality of individual cold cathodes connecting to the cathode lines on the base plate, an isolation layer overlying the cathode lines on the base plate, and means for extracting electron beams from the individual cathodes which are directed towards corresponding fluorescer members, said means for extracting comprising extraction electrodes on the isolation layer adjacent the individual cathodes;

a space between the cathode panel and the back panel, and gas absorbing getters being provided in said space; and said getters comprising pillar shaped supports formed of a getter material distributed throughout said active image area of said display device including a center thereof and between said cathode panel and back panel so as to support said cathode panel by said back panel in a distributed manner.

6. An image display device according to claim 5 wherein said cathodes comprise conical projections having a diameter of substantially one micron or less.

7. An image display device according to claim 5 wherein said pillar shaped supports are cylindrical.

8. An image display device according to claim 7 wherein said cylindrical pillar shaped supports each have central auxiliary members running axially along the supports from the back panel toward the cathode panel, said auxiliary members enhancing a pressure withstanding capability provided by the distributed pillar shaped supports for the cathode panel.

9. An image display device having a cathode panel between a light transparent front panel and a back panel in such a manner that a space is existent between the cathode panel and the back panel, said front panel having a plurality of phosphorescent image forming elements thereon, said cathode panel having a plurality of cathodes corresponding to the phosphorescent elements thereon and an extraction electrode means for promoting an electron beam emission from the individual cathodes to said phosphorescent elements, and said cathode panel being supported in said space by a plurality of getters.

10. An image display device, comprising:

a light transparent front panel, a back panel, and a cathode panel between the front and back panels;

a plurality of image forming phosphorescent elements on said front panel;

said cathode panel being formed of a base plate and a plurality of individual cold cathodes supported by the base plate, and means for extracting electron beams from the individual cathodes, said means for extracting comprising extraction electrodes adjacent the individual cathodes;

a space between the cathode panel and the back panel, gas absorbing getters being provided in said space; and a plurality of through hole means at a central portion of an active image area of said image display device for diffusion of residual gases from the central active image area between the front panel and back panel to said gas absorbing getters, said hole means comprising a plurality of holes distributed throughout at least a central portion of said active image area and adjacent the cathode elements, said holes piercing through said base plate.

* * * * *